United States Patent [19]

Schwabacher

[11] 4,116,353

[45] Sep. 26, 1978

[54] SELF-CENTERING ROTATABLE CLOSURE RETAINER

[75] Inventor: William Peter Schwabacher, Wharton, N.J.

[73] Assignee: Hoffmann-La Roche Inc., Nutley, N.J.

[21] Appl. No.: 770,250

[22] Filed: Feb. 18, 1977

[51] Int. Cl.[2] ..... B65D 45/32

[52] U.S. Cl. ..... 215/274; 215/277

[58] Field of Search ..... 215/307, 274, 277, DIG. 1, 215/100.5; 206/591, 594; 220/240

[56] References Cited

U.S. PATENT DOCUMENTS

| | | | |
|---|---|---|---|
| 3,211,322 | 10/1965 | Collons | 220/240 |
| 3,285,456 | 11/1966 | Pewitt | 215/100.5 |
| 3,338,390 | 8/1967 | Gordon | 206/591 |
| 3,392,824 | 7/1968 | Flynn | 206/594 |
| 3,437,224 | 4/1969 | Williams | 215/307 |
| 3,633,863 | 1/1972 | Abbey | 215/100.5 |
| 3,941,237 | 3/1976 | MacGregor, Jr. | 215/DIG. 1 |

*Primary Examiner*—Ro E. Hart

*Attorney, Agent, or Firm*—Samuel L. Welt; George M. Gould; Raymond R. Wittekind

[57] ABSTRACT

A self-centering rotatable closure retainer adapted for use with a conventional cylindrical primary container cap is disclosed. The retainer comprises a support to which three or more radially inwardly projecting flexible ribs are attached so that they tangentially engage the outer wall of the cap frictionally securing the retainer to the cap. The self-centering closure retainer can be readily rotated about and removed from the primary cap without disturbing the cap.

2 Claims, 7 Drawing Figures

SELF-CENTERING ROTATABLE CLOSURE RETAINER

BACKGROUND OF THE INVENTION

This invention relates generally to a closure retainer primary container cap combination. More particularly, this invention involves a self-centering closure retainer which is readily rotatable about and removable from the primary cap without disturbing the cap.

For decorative and protective purposes it is usually desirable to equip containers bearing consumer products with an overcap in addition to the primary closure. This is expecially important with containers incorporating a pumping or other mechanism in the primary cap. Numerous overcaps have been employed for this purpose. They are uniformly of a permanent locking type whereby the overcap is not readily rotatable about or removable from the primary cap without disturbance, i.e., primarily loosening of the primary cap, increasing the possibility of spillage and damage. They are also uniformly not of a self-centering type and require a centering mechanism or embodiment.

A principal object of the present invention is to provide a closure retainer primary container cap combination which is readily rotatable about and removable from the primary cap without loosening of the cap.

Another object of the present invention is to provide a closure retainer primary container cap combination which is self-centering.

Still another object of the present invention is to provide a closure retainer to be used with, for example, a dome and lens to form a decorative, protective overcap.

These and other objects of the present invention will become readily apparent from the following detailed description of the invention considered with the appended claims.

SUMMARY OF THE INVENTION

In accordance with the present invention, the foregoing objects are achieved by a support means having three or more radially inwardly projecting flexible ribs cooperating with a cylindrical primary container cap which permits rotation and removal of the closure retainer without disturbance (loosening) of the primary cap and self-centering of the closure retainer over the primary cap. The support means is constructed of a resilient plastic material such as, for example, polyethylene, polypropylene, polystyrene and the like, and comprises a collar to which three or more flexible ribs, preferably fabricated of the same resilient material as the support means, are radially inwardly fixed in a substantially axial position at an angle to the collar inner wall such that they engage the surface of the primary cap tangentially, not perpendicularly, and in a configuration such that the angle of attachment of the ribs to the collar inner wall and the distance between the ribs are equal when an odd number of ribs is utilized and the angle of attachment of the ribs to the collar inner wall and the distance between opposing ribs are equal when an even number of ribs is utilized.

The collar is characterized by having a geometrically symmetrical cross-section such as those, for example, defined by an equilateral or isosceles triangle, square, rectangle, regular hexagon or octagon, circle, ellipse and the like. A lower platform conforming to the configuration of the collar outer wall may extend outwardly from the collar outer wall to provide support for a decorative dome enclosing the retainer and, if desired, a lens to enhance the decorative effect. Alternatively, a cover having any suitable shape may be molded to the upper collar section forming a unitary closure retainer.

The outer surface of the cylindrical primary cap may have any appropriate texture. For example, it may be smooth, grooved, pocked and the like.

The preferred embodiments of the invention are illustrated by way of exemplification in the accompanying drawings in which.

For purposes of this patent application it will be understood that the container stands upright with the primary cap in place and the closure retainer and, if desired, the dome and lenz all successively thereover. Accordingly, positioning of parts will be described with relation to the axis of the container. Thus, the term "axially" will mean either upwardly or downwardly while the term "radially" will mean either inwardly toward the axis or outwardly away from the axis of the container in the upright position.

Figure 1:
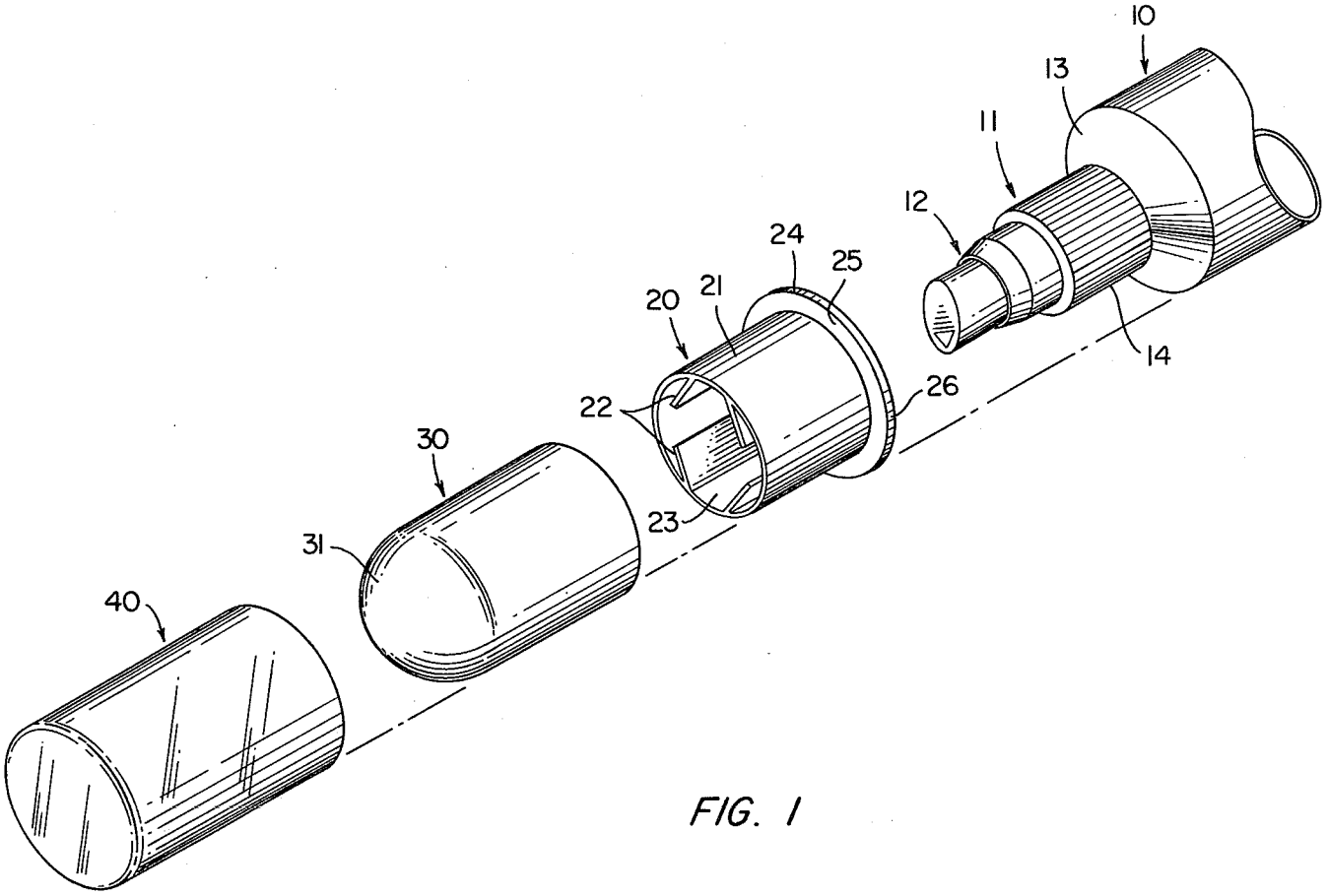
FIG. 1 is an exploded perspective view of the self-centering, rotatable closure retainer in cooperation with the primary cap attached to a container fitted with a pumping mechanism showing the decorative dome annd lens.
Figure 2:
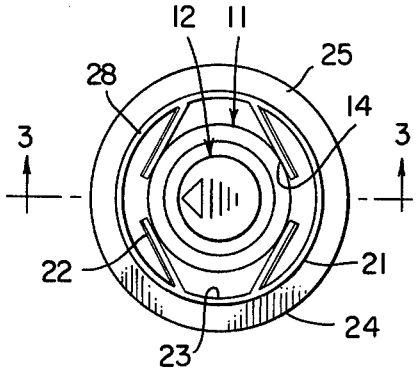
FIG. 2 is a top plane view of the closure retainer.
Figure 5:
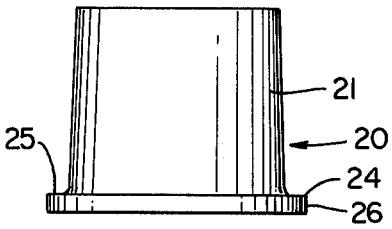
FIG. 5 is a side plane view of the closure retainer.

Referring now to the drawings in detail, FIG. 1 illustrates a self-centering, rotatable closure retainer 20 for a cylindrical primary container cap 11 of a container 10 comprising an annular collar generally referred to by numeral 21and four flexible ribs 22 protruding radially inwardly from the collar inner wall 23. The container 10 and primary cap 11 are of conventional construction, and the container may be equipped with a pumping mechanism 12 requiring protection by the closure retainer 20. Primarily for decorative purposes, the dome 30, which may be fabricated from a resilient plastic material, and, which may be coated on the outer surface with a thin layer of an attractive material, may be concentrically positioned, i.e., nested, over the retainer closure 10. A transparent substantially radially distortion-free lens 40 may in turn be concentrically positioned, i.e., nested, over the dome 30 to enhance the decorative effect of the upper surface 31 of the coated dome 12. As is best seen in FIGS. 2 and 5, the collar 21 is provided with a lower annular platform 24 extending radially outwardly around the circumference of the collar 21 forming an annular upper flat surface 25 upon which the dome 30 may rest, the lens 40 being molded to the annular upper flat surface 25 of the platform 23. The outer reaction of the annular platform 24 extends axially downwardly forming an annular skirt 26 the bottom surface 27 of which may rest on the shoulder 13 of the container 10, as readily seen in FIGS. 3 and 4.

Figure 3:
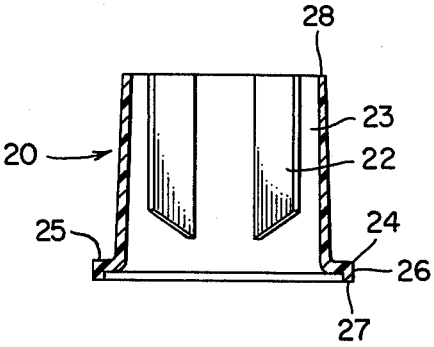
FIG. 3 is a vertical cross-sectional view of the closure retainer taken through the line 3—3 of FIG. 2.
Figure 4:
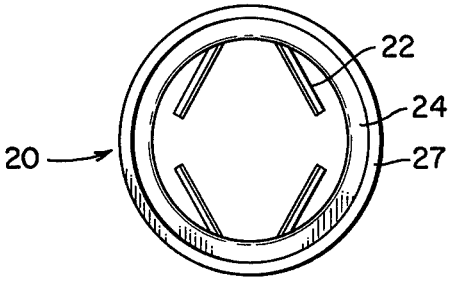
FIG. 4 is a bottom plane view of the closure retainer.

The annular collar 21 has four flexible ribs 22 attached radially inwardly to the inner wall 23 of the collar 21 in a substantially axially vertical position, as seen in FIG. 3, at an angle to the tangent of the collar inner wall 23 at the point of attachment of a value other than 90° engaging the outer surface 14 of the primary cap 11 tangentially, not perpendicularly, to secure the closure retainer 20 to the primary cap 11 and simultaneously to permit rotation and removal of the closure retainer 20 without disturbance of the primary cap 11. The ribs 22 are symmetrically fixed to the collar inner wall 23, the distances between the points of attachment of adjacent ribs, i.e., those ribs the radially outward extensions of which intersect, being equal and distances between the points of attachment of opposing ribs, i.e., those ribs the radially outward extensions of which do not intersect, also being equal, but not one to the other, to provide self-centering of the closure retainer 21 over the primary cap 2.

Figure 6:
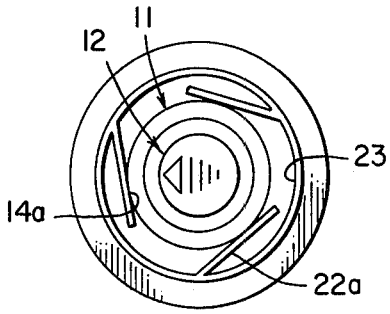
FIG. 6 is a top plane view of another embodiment of the closure retainer.

In another embodiment, the present invention, as is best seen in FIG. 6, the aforementioned objects are attained by three flexible ribs 22 projecting radially inwardly from the collar inner wall 23 and fixed to the collar inner wall 23 in a substantially axially vertical position at an angle to the tangent of the collar inner wall 23 and the point of attachment of a value other than 90° engaging the outer surface 14 of the primary cap 11 tangentially, not perpendicularly, to secure the closure retainer 20 to the primary cap 11. The ribs 22 are symmetrically positioned to the collar inner wall 23, the distances between the point of attachment of the ribs 22 being equal, one to each other.

Figure 7:
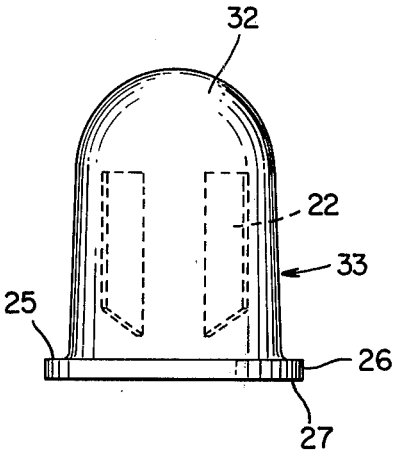
FIG. 7 is a side plane view of a unitary closure retainer showing the flexible ribs.

While the present invention is generally proficient using separate closure retainer 20 and dome 30, the closure retainer 20 may be fabricated with an oval cover 32 molded to the upper collar reaction 2 forming a unitary closure retainer 32, as particularly shown in FIG. 7.

The annular collar 21, flexible ribs 22 and associated parts, forming the closure retainer 21, are made of a suitable resilient plastic material such as polyethylene, polypropylene, polystyrene or the like. While the annular collar 21, flexible ribs 22 and platform 24 may be fabricated from different resilient materials, it is preferred that the same plastic material be used for the depending parts.

In use, the closure retainer 20 is placed over the primary cap 11 so that the lower surface 27 of the skirt 26 sets securely on the shoulder 13 of the container 10.

While specific structural details have been shown and described, it should be understood that changes and alterations may be resorted to without departing from the spirit of the invention as defined in the appended claims.

I claim:

1. A self-centering rotatable closure retainer in combination with a cylindrical axially serrated cap comprising:

(a) a substantially annular collar; and (b) four axially elongated flexible ribs inwardly mounted to the collar so that the ribs tangentially engage the outer wall of the cap to frictionally secure the retainer on the cap, the ribs extending past the point of tangency with the cap and being substantially symmetrically positioned to the collar inner wall so that opposing ribs extend radially inwardly toward the inner ends of one another to permit centering of the cap and free rotation of the retainer around the cap.

2. The retainer of claim 1 wherein the ribs are positioned so that their points of attachment to the collar inner wall define substantially a rectangle.

* * * * *